United States Patent [19]

Webinger

[11] Patent Number: 4,502,600

[45] Date of Patent: Mar. 5, 1985

[54] RECLOSABLE CARTON WITH INTERIOR TAB AND BLANK THEREFOR

[75] Inventor: George P. Webinger, Robbinsdale, Minn.

[73] Assignee: Champion International Corporation, Stamford, Conn.

[21] Appl. No.: 462,759

[22] Filed: Feb. 1, 1983

[51] Int. Cl.[3] ..... B65D 5/70

[52] U.S. Cl. ..... 206/626; 206/631

[58] Field of Search ..... 206/626, 621, 622, 631, 206/633; 229/39 R, 17 R

[56] References Cited

U.S. PATENT DOCUMENTS

| | | | |
|---|---|---|---|
| 2,760,713 | 8/1956 | Andrews | 206/633 |
| 3,059,827 | 10/1962 | Pellaton et al. | 206/626 |
| 3,319,869 | 5/1967 | Ostwald | 229/39 R |
| 3,603,502 | 9/1971 | Howard et al. | 206/626 |
| 3,971,506 | 7/1976 | Roenna | 206/626 |

FOREIGN PATENT DOCUMENTS

| | | | |
|---|---|---|---|
| 1518909 | 3/1968 | France | 206/626 |

*Primary Examiner*—Stephen P. Garbe

*Attorney, Agent, or Firm*—Evelyn M. Sommer; John H. Mulholland; William W. Jones

[57] ABSTRACT

A reclosable paperboard carton and blank therefor, which carton has overlapping and glued end panels closing one end thereof. Once the end panels are opened, they can be reclosed by inserting a straight distal edge of one of the panels under an arcuate tab defined in the interior of the other panel. Using a plain, straight distal edge on the insertable panel reduces paperboard waste and manufacturing costs since exterior locking tabs are eliminated and single knife cutting can be used. In one embodiment, the tab is defined by an arcuate cut line and two spaced perforated lines extending from the arcuate line to the distal edge of the panel. In a second embodiment, the tab is defined by a cut-out recess extending from the distal edge of the panel and having an arcuate bottom edge.

2 Claims, 9 Drawing Figures

RECLOSABLE CARTON WITH INTERIOR TAB AND BLANK THEREFOR

FIELD OF THE INVENTION

The invention relates to paperboard cartons and blanks therefor which have reclosable overlapping panels. Once the panels are opened, they can be reclosed by inserting the straight distal edge of one of the overlapping panels under an arcuate tab defined in the interior of the other overlapping panel.

BACKGROUND OF THE INVENTION

Paperboard cartons having reclosable end panels for keeping their contents fresh are known in the art. Typically, the end panels of the carton are overlapped and glued together. Once they are opened by separating the panels, they are reclosed by interlocking these panels. A usual type of interlocking reclosure mechanism is formed by an exterior tab extending from one of the panels and a slit in the other panel which receives the tab therein.

However, using such an exterior tab on one of the panels results in numerous disadvantages. First, the protruding tab requires nesting with adjacent paperboard blanks during manufacture and therefore requires more paperboard. Secondly, in order to define the protruding tab, the manufacturing process requires multiple knife cutting which is expensive. Finally, stripping of one paperboard blank from another after the cutting has been accomplished slows down the manufacturing process.

SUMMARY OF THE INVENTION

Accordingly, a primary object of the invention is to provide a paperboard carton and blank therefor which is reclosable and is cheaper and more easily constructed than known in the prior art.

Another object of the invention is to provide such a reclosable paperboard carton and blank that eliminates nesting during manufacture and thereby reduces overall paperboard use.

Another object of the invention is to provide such a paperboard carton and blank that allows single knife cutting and a quicker stripping of one paperboard blank from adjacent paperboard blanks, thereby reducing manufacturing costs.

The foregoing objects are basically attained in a paperboard carton having a tubular body portion, means for closing a first end of the tubular body portion, and first and second overlapping end panels hingedly coupled to the tubular body portion at the second end of the tubular body portion to close the second end, the improvement comprising a straight distal edge formed on the first end panel, and means defining a tab in the interior of the second end panel, the tab facing towards the distal edge of the second end panel and being pivotable out of the plane containing the second end panel, the straight distal edge on the first end panel being insertable under the tab and over the portions of the second end panel on opposite sides of the tab for interlocking the first and second end panels and closing the second end of the tubular body portion.

Advantageously, in a first embodiment, the means defining the tab comprises an arcuate cut line and a pair of space perforated lines extending inwardly from the distal edge of the second end panel and being connected by the arcuate cut line. In a second embodiment, the means defining the tab comprises a cut-out recess formed in the second end panel which extends inwardly from the distal edge of the second end panel and has an arcuate bottom edge.

In connection with the means defining the tab and specifically the references to an arcuate cut line and an arcuate bottom edge, it is to be appreciated that while the foregoing results in a tab having an arcuate shape, this is merely a preferred execution and the tab can take various other forms i.e., trapezoidal, rectangular, etc., by suitable design of the means defining the tab.

Other objects, advantages and salient features of the invention will become apparent from the following detailed description which, taken in conjunction with the annexed drawings, discloses preferred embodiments of the invention.

DRAWINGS

Referring now to the drawings which form a part of this original disclosure:

DETAILED DESCRIPTION OF THE INVENTION

Referring now to FIGS. 1–7, the first embodiment of the invention is shown comprising an integrally formed, one-piece paperboard blank 10 for constructing the carton.

Figure 2:
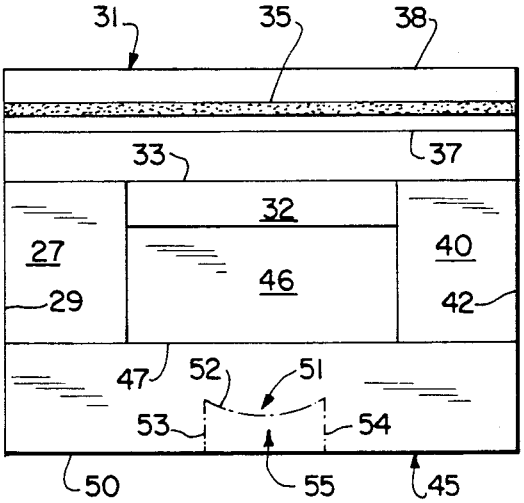
FIG. 2 is an end elevational view of the constructed carton formed from the paperboard blank of FIG. 1 with the two end panels forming the reclosable assembly being shown in the open position.

The blank 10 comprises a left side panel 12, a rear panel 14, a right side panel 16, a front panel 18 and a glue flap 20 pivotally coupled in series along parallel hinge lines 22–25, each of these panels being rectangular. The glue flap 20 is substantially trapezoidal in shape and can have a line of glue 26 on the outer surface as indicated by dotted lines for connecting panels 12, 14, 16 and 18 into a tubular body portion as illustrated in FIG. 2. First and second rectangular end flaps 27 and 28 are pivotally coupled along parallel hinge lines 29 and 30 on opposite ends of the left side panel 12. First and second rectangular end panels 31 and 32 are pivotally coupled along parallel hinge lines 33 and 34 on opposite ends of the rear panel 14. These end panels 31 and 32 have a width substantially equal to the width of the rear panel 14 and have lines of glue 35 and 36 extending thereacross to close the opposite ends of the carton formed from the blank 10 once the carton is constructed. The first end panel 31 has a hinge line 37 formed across its width, such as by a light scoring thereof, to aid in opening the end of the carton. In addition, the first end panel 31 has a straight distal edge 38 extending across its entire width, this edge being the free edge of the panel and spaced from the hinge line 33.

Third and fourth rectangular end flaps 40 and 41 are pivotally coupled along parallel hinge lines 42 and 43 on opposite ends of the right side panel 16.

Third and fourth rectangular end panels 45 and 46 are similarly pivotally coupled along parallel hinge lines 47 and 48 on opposite ends of the front panel 18.

Figure 1:
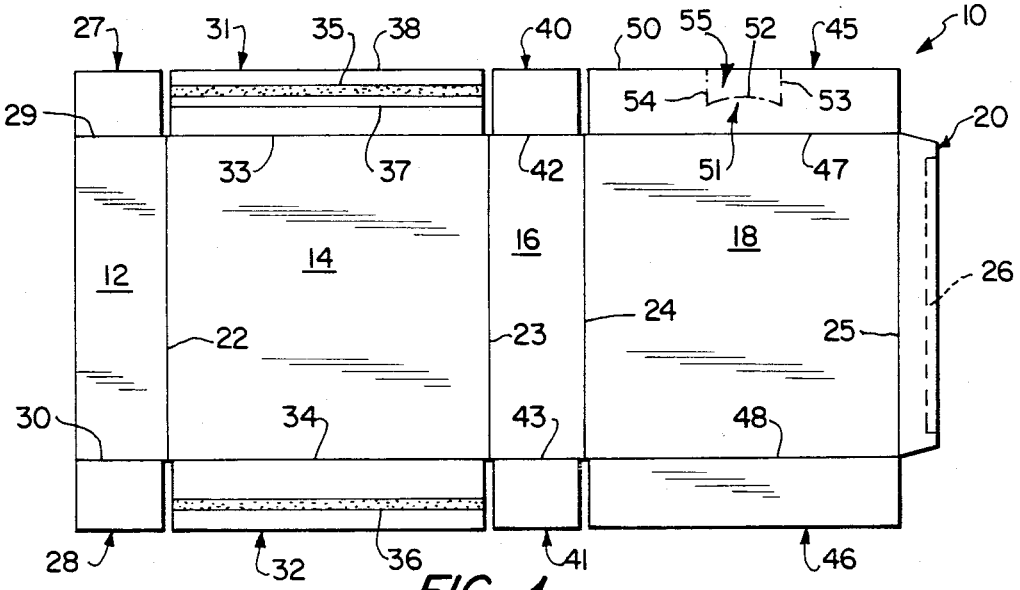
FIG. 1 is a top plan view of the inside surface of a paperboard blank used to form the carton in accordance with the invention.

The reclosable assembly for the carton formed from blank 10 includes the first end panel 31 and the third end panel 45. As seen in FIG. 1, the third end panel 45 has a straight distal edge 50 on the opposite side of the panel interior from hinge line 47 where the panel 45 is coupled to front panel 18 of the tubular body. The interior of panel 45 has a tab 51 defined therein which faces towards the distal edge 50 of the third end panel and is pivotable out of the plane containing the end panel. This tab is defined by an arcuate cut line 52 which has a convex configuration facing the distal edge 50 of the third end panel. In addition, a pair of spaced, parallel perforated lines 53 and 54 are defined in the third end panel and extend inwardly from the distal edge 50, these perforated lines being connected by the arcuate cut line 52. Thus, as seen in FIG. 1, an area 55 is defined in the third end panel 45 by means of the distal edge 50, the cut line 51, and the spaced perforated lines 53 and 54. This area 55 is removable from the end panel as will be described in more detail hereinafter.

As seen from FIG. 1, the tab 51 is located substantially centrally of the rectangular third end panel 45 in the interior thereof.

Figure 3:
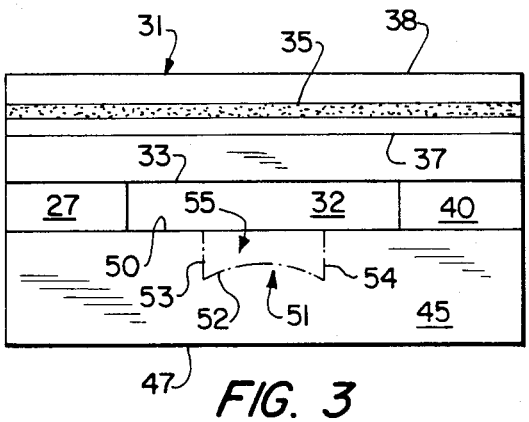
FIG. 3 is an end elevational view similar to that shown in FIG. 2 except that the end panel having the tab defined therein has been folded into a closed position.
Figure 4:
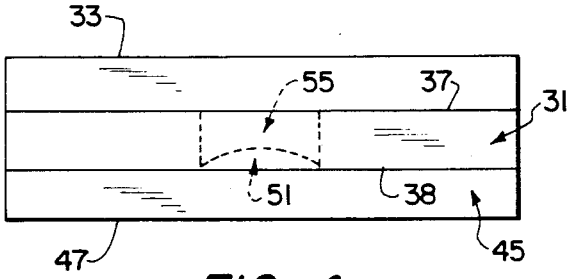
FIG. 4 is an end elevational view similar to that shown in FIG. 3 except that, with glue applied to the inside thereof, the other end panel forming the reclosable assembly has been folded into the closed position, and overlaps the end panel carrying the tab, these panels thus being glued together.

As seen in FIGS. 1–3, the perforated lines 53 and 54 and the cut line 52 are illustrated by dot-dash lines which is meant to provide a diagramatic illustration of these lines as they are actually exposed to view in FIGS. 1–3. In FIG. 4, as will be described in more detail hereinafter, these perforated lines and the cut line are illustrated by dashed lines to indicate that they are not directly visible in FIG. 4 but are instead covered by the first end flap 31.

CONSTRUCTION OF THE CARTON FROM BLANK 10

Referring now to FIGS. 2–7, the carton in accordance with the present invention is constructed in a conventional manner by using the paperboard blank 10 shown in FIG. 1. Thus, a tubular body portion is formed by panels 12, 14, 16 and 18, as well as the glue flap 20, and the end flaps are folded inwardly as shown in FIG. 2. One end of the tubular body portion so formed is closed by overlapping end panels 32 and 46 and connecting them by the line of glue 36 and the other end is closed by overlapping end panels 31 and 45 and connecting them by the line of glue 35.

This overlapping of end panels 31 and 45 is illustrated in FIGS. 2–4. Thus, with the constructed carton set up with one end closed but the other still open, end flaps 31 and 45 have not yet been overlapped and are in the open position shown in FIG. 2. Then, end panel 45 is folded over end flaps 27 and 40 around hinge line 47 as shown in FIG. 3. Following this, with glue line 35 applied to end panel 31, this end panel is folded over, into an overlapping and contacting position with regard to end panel 45 as illustrated in FIG. 4, thus completely closing the carton. It should be noted that the glue line 35 contacts the outer surface of end panel 45 including area 55 defined therein.

Figure 5:
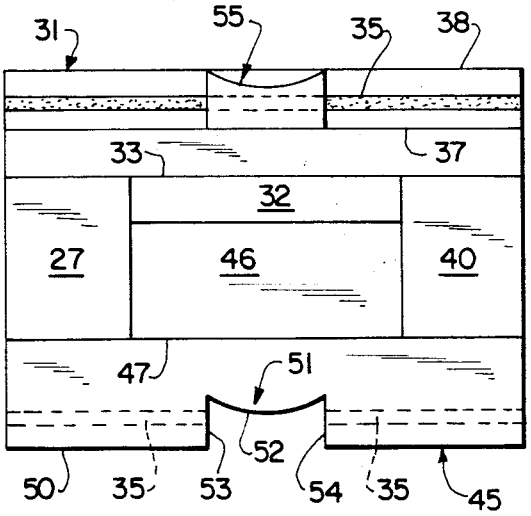
FIG. 5 is an end elevational view similar to that shown in FIG. 4 except that the end panels have been opened by overcoming the glued attachment thereof and outwardly pivoting the two end panels.

To open the carton shown in FIG. 4, end flaps 31 and 45 are manipulated so as to separate their glued connection and are pivoted open along their respective hinge lines 33 and 47 as shown in FIG. 5. In FIG. 5, tab defining the residue of the glue is shown in dotted lines on the outside of end panel 45 and in solid lines on the inside of end panel 31. In addition, as illustrated in FIG. 5, area 55 becomes and stays attached to end panel 31 because of glue line 35 being adhered thereto upon the initial closing thereof. Thus, when end panel 31 is moved away from end panel 45, area 55 is separated from end panel 45 along the perforated lines 53 and 54 as well as cut line 52. This also exposes the arcuate edge defined by cut line 52 of tab 51.

Figure 6:
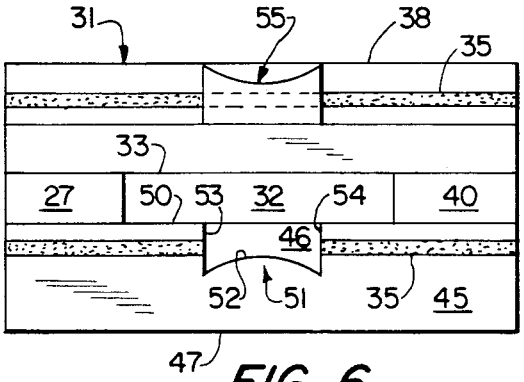
FIG. 6 is an end elevational view similar to that shown in FIG. 5 except that the end panel having the tab defined therein has been pivoted back to the closed position.
Figure 7:
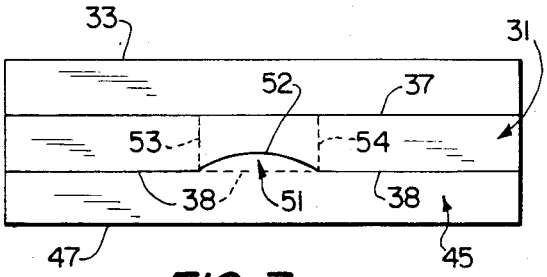
FIG. 7 is an end elevational view similar to that shown in FIG. 6 except that the opened end panel shown in FIG. 6 has been folded over the closed end panel defining the tab so that these panels overlap and in addition so that the tab receives the straight distal edge of the opposed end panel, thereby reclosing the carton.

In order to reclose the carton, the end panel 45 is refolded into the closed position along hinge line 47 as seen in FIG. 6 and then the end panel 31 is pivoted into an overlapping position with regard to end panel 45, with the straight distal edge 38 of end panel 31 being inserted under tab 51 and over the portions of end panel 45 on opposite sides of the tab. This interlocks end panels 31 and 45 and closes the end of the carton, as illustrated in FIG. 7, with the tab 51 being slightly pivoted out of the plane containing the end panel 45.

EMBODIMENT OF FIGS. 8 AND 9

Figure 8:
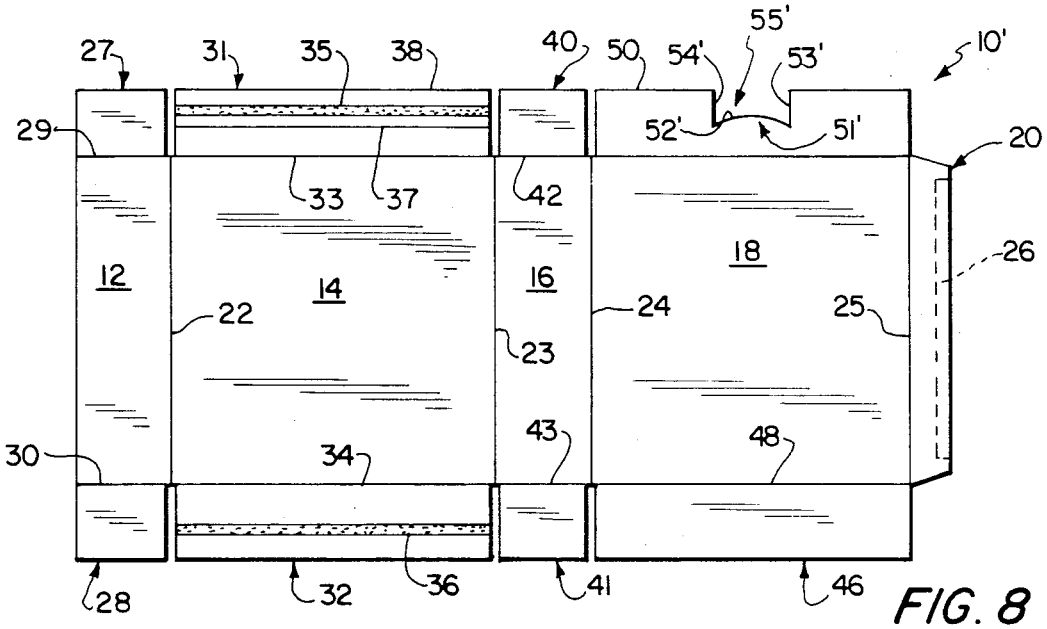
FIG. 8 is a top plan view of a modified embodiment of the paperboard blank in accordance with the invention in which the tab on one of the end panels is defined by a cut-out recess.
Figure 9:
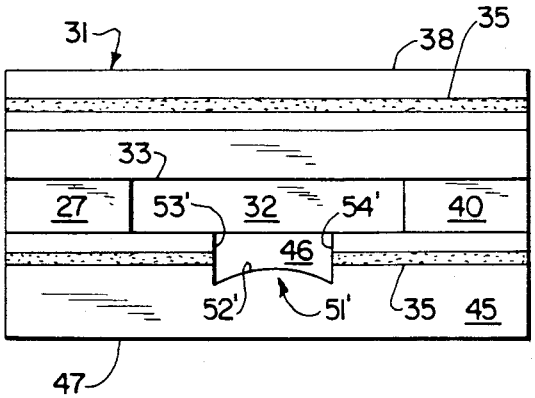
FIG. 9 is an end elevational view similar to FIG. 6 in configuration and position but showing the carton constructed by the modified blank shown in FIG. 8.

A second embodiment of the invention is illustrated in FIGS. 8 and 9 wherein the paperboard blank 10′ is essentially the same as blank 10 shown in FIG. 1 except that the area 55 in blank 10 is completely removed during manufacture of the blank.

Thus, blank 10′ comprises the same flaps, panels, glue lines and hinge lines as described above with regard to blank 10 and like reference numerals are used therefor.

In blank 10′, however, a cut-out recess 55′ is formed in end panel 45 extending inwardly from the distal edge 50 thereof and having an arcuate bottom edge 52′ with a convex configuration facing towards the distal edge 50. The sides of the recess 55′ are formed from spaced, parallel interior straight edges 53′ and 54′. The tab 51′ is defined in the interior of end panel 45 by the arcuate bottom edge 52′ of recess 55′.

The construction of the carton using blank 10′ is the same as that described above regarding blank 10, except that when end panels 31 and 45 are overlapped, glue line 35 does not adhere to an area 55 in panel 45 since this has already been removed during manufacture of the blank 10′.

FIG. 9 illustrates the carton formed from blank 10' in a condition and position analogous to that shown in FIG. 6, again without the area 55, wherein the end panel 31 can be folded into an overlapping position relative to end panel 45 so that the distal edge 38 of end panel 31 can be inserted under tab 51' and over the portions of end panel 45 on opposite sides of tab 51' for interlocking panels 31 and 45 and thereby closing the end of the carton.

While various advantageous embodiments have been chosen to illustrate the invention, it will be understood by those skilled in the art that various changes and modifications can be made therein without departing from the scope of the invention as defined in the appended claims.

What is claimed is:

1. A paperboard carton having a tubular body portion, comprising:

means for closing a first end of the tubular body portion, and first and second overlapping and initially glued end panels hingedly coupled to the tubular body portion at the second end of the tubular body portion to close the second end, a straight distal edge and a line of glue substantially parallel thereto substantially completely across the width of the first end panel, and a distal edge formed on the second end panel on the opposite side of the panel from where the panel is coupled to the body, and means intermediate said distal edge defining a tab in the interior of the second end panel, said tab facing towards the distal edge of the second end panel and being pivotable out of the plane containing the second end panel, after separating said overlapped and glued end panels to open said carton, said straight distal edge on the first end panel being insertable under said tab and over the portions of the second end panel on opposite sides of said tab for interlocking the first and second end panels and reclosing the second end of the tubular body portion.

2. The paperboard carton of claim 1 in which a tab defining panel area defined by perforated lines is included which stays glued to the first end panel and separates from the second end panel during initial opening of the carton.

* * * * *